United States Patent [19]

Frielinghaus

[11] Patent Number: 4,630,792

[45] Date of Patent: Dec. 23, 1986

[54] RAILWAY WHEEL DETECTOR

[75] Inventor: Klaus H. Frielinghaus, Rochester, N.Y.

[73] Assignee: General Signal Corporation, Stamford, Conn.

[21] Appl. No.: 690,288

[22] Filed: Jan. 10, 1985

[51] Int. Cl.[4] ..... B61L 1/04

[52] U.S. Cl. ..... 246/369; 200/61.41; 246/204; 246/247; 246/351

[58] Field of Search ..... 246/126, 181, 201, 204, 246/205, 247, 302, 313, 351, 368, 369; 200/61.41, 302.2

[56] References Cited

U.S. PATENT DOCUMENTS

| | | | |
|---|---|---|---|
| 166,558 | 8/1875 | Rousseau | 246/313 X |
| 184,842 | 11/1876 | Conklin, Jr. | 246/313 X |
| 2,157,602 | 5/1939 | Gilmore | 246/204 UX |
| 3,341,703 | 9/1967 | Ward | 246/247 |
| 3,538,272 | 11/1970 | Sibley | 200/61.41 |
| 3,941,338 | 3/1976 | Knudsen | 246/77 |
| 4,076,192 | 2/1978 | Hoge | 246/247 |
| 4,128,218 | 12/1978 | Pohlig | 246/247 |

FOREIGN PATENT DOCUMENTS

| | | | |
|---|---|---|---|
| 333581 | 6/1921 | Fed. Rep. of Germany | 246/247 |
| 1044861 | 11/1958 | Fed. Rep. of Germany | 246/247 |
| 363405 | 12/1931 | United Kingdom . | |
| 855676 | 12/1960 | United Kingdom | 200/302.2 |
| 888193 | 1/1962 | United Kingdom . | |

OTHER PUBLICATIONS

Mechanical Enterprises, Inc., "Your Make or Buy Answer—The DN Series Keyswitch", Model DN500, (brochure).

Transcontrol, "Mechanical Wheel Detector", (brochure), 2-1981.

Silec-Division Signalisation Ferroviaire, 1002/PCB, Electromechanical Detectors, 5-1982, (brochure).

MORS Signalisation, "Electromechanical Treadle for the Detection of Railway Traffic", (brochure).

*Primary Examiner*—Randolph A. Reese

*Attorney, Agent, or Firm*—Martin LuKacher

[57] ABSTRACT

A railway wheel detector which is mechanically actuated by the flange of a railway wheel which engages a contacting surface of the detector which may be provided by a rigid plate. This surface is supported by blocks of compressible, resilient material, preferably a closed cell foam elastomeric material, which has more stiffness in a vertical direction than in a longitudinal direction (the direction along the railway track) so as to transmit forces for actuating the plunger of an electrical switch mechanism when the flange of the railway wheel contacts the contacting surface, but allows the contacting surface to move with the wheel to avoid wear, thereby providing reliable operation over a long life time. The switch is preferably hermetically sealed and the blocks of compressible, resilient material are preferably covered by a boot having bellows walls so as to enable the wheel detector to be installed outdoors on the rail of a railway track and to withstand severe environmental conditions. A pair of such switches, together with blocks of compressible, resilient material which support contacting surfaces in close proximity to each other and longitudinally spaced along the railway track, is assembled in an integral unit so as to detect not only the presence but also the travel direction of the railway wheels and the axles which connect them.

17 Claims, 4 Drawing Figures

RAILWAY WHEEL DETECTOR

DESCRIPTION

The present invention relates to railway wheel detectors which are operative to detect the presence of wheels and wheel axles on railroad cars and also the direction of travel thereof. The invention is especially suitable in providing purely mechanical railway wheel detectors as opposed to electronic, photoelectric or electromagnetic wheel detector devices. A wheel detector provided in accordance with the invention is therefore especially suitable for use on electrified railways where track currents are present which may adversely affect other than a purely mechanical wheel detector device.

Mechanical wheel detector devices have mechanisms, usually including a pivoted arm, which are actuated by the flange of the railway wheel (see U.S. Pat. Nos. 3,538,272 issued Nov. 3, 1970, and 4,076,192 issued Feb. 28, 1978). As recognized in U.S. Pat. No. 3,538,272, the flange, and particularly the points on its outer circumference which strike the wheel detector, executes a looped, cycloidal path. Since wheel detectors are engaged by tens of thousands of wheel flanges over a short period of time, they can soon wear out. However, wheel detectors are generally quite expensive and reliable operation over a long lifetime is a prerequisite of railway operations; therefore, mechanical wheel detectors have not gone into extensive use, in spite of the need for such detectors on electrified railways where track currents may affect the reliable operation of the electronic and electro-magnetic wheel detector devices.

The present invention provides an improved railway wheel detector of the mechanical type wherein the problems of mechanical wheel detectors which have heretofore been proposed are attacked from two directions. First, a mechanical wheel detector provided in accordance with the present invention is made low in cost so that it can be replaced at much lower expense than was the case with wheel detectors heretofore available. Second, the wear on the wheel detector due to sliding or scuffing of the flange thereon is minimized. It is a further feature of the invention to minimize such wear, and nevertheless be capable of detecting wheels which are worn along their treads which makes the wheel detector subject to greater and longer duration sliding and scuffing forces from the flange.

Briefly described, the invention provides apparatus for use on a railway track for detecting flanged wheels of railway vehicles on the track. In the apparatus, there is a body having an opening which extends downward from a surface thereof. An electrical switch having a depressable plunger is mounted in the body with the switch plunger in the opening and extending upwardly in the direction of the surface of the body. Means are provided, which are operated by the flange of the railway vehicle, for actuating the switch by depressing and releasing the plunger. The actuating means has a surface contacted by the wheel (the contacting surface). This surface is spaced above the bottom of the cycloidal path taken by any point of the outer circumference of the flange as it moves along the track. This cycloidal path has both vertical and longitudinal (in the direction along the track) components of motion. The switch actuating means includes a body of compressible resilient material, preferably a closed foam elastomeric material, which supports the contacting surface for both vertical and longitudinal movement. The body of compressible elastomeric material has a surface, on the lower end thereof, which bears upon the surface of the switch containing body and bridges the opening therein. This lower end surface of the body of compressible resilient material moves vertically into contact with the plunger for depressing the plunger and actuating the switch when the contacting surface is engaged by the flange. However, since the contacting surface is supported by the body of compressible resilient material which is compliant in the longitudinal direction, the contacting surface moves both vertically and laterally with the wheel flange so that wear at the contacting surface is minimized. The entire device has a minimum of parts, none of which are of complex design, and may be fabricated at low cost.

The foregoing and other features, objects and advantages of the invention, as well as presently preferred embodiments thereof, will become more apparent from the reading of the following description in connection with the accompanying drawings in which.

Figure 1:
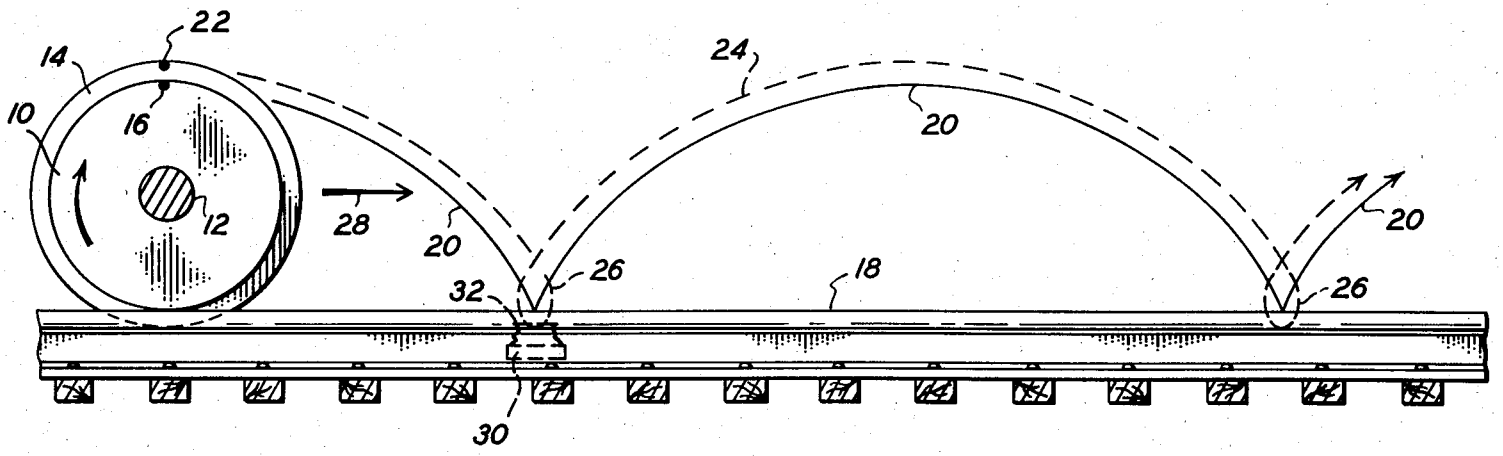
FIG. 1 is a diagram taken of one rail of a railway track from a location between the rails and showing the cycloidal path movement of points of the outer circumference of a railway wheel and the location of a wheel detector provided in accordance with the invention for detecting the wheel.

Referring more particularly to FIG. 1, there is shown a railway wheel 10, its axle 12 and its flange 14. Points (e.g., 16), on the circumference of the tread of the wheel as it rotates and travels along the railway track 18, execute paths. These paths consist of a series of half sinusoids 20.

However, points on the outer circumference of the flange 14, one of which is illustrated at 22, execute a cycloidal path illustrated by the dashed line 24. The path taken by the point 22 executes a succession of loops 26. These loops show that the point 22 has both a vertical component and a horizontal component in the direction opposite to the direction of travel (indicated by the arrow 28).

A railway wheel detector 30 provided by the invention is mounted on the inside of the track 18. It has a contacting surface 32 which is positioned above the bottom of the path of the points 22. This position is above the likely position of the flange, even on wheels which are not worn. It is therefore seen that the flange engages the contacting surface 32 of the detector 30 with both a vertical and longitudinal (in the reverse direction of travel 28 along the track 18) component of motion. The wear on the wheel detector contacting surface 32 is minimized in accordance with the invention by minimizing the sliding or scuffing of the flange on the surface 32 by designing the actuating means of the detector 30 so that the contacting surface moves sufficiently vertically to actuate the detector, but also moves in the lateral direction so that it can follow the reverse movement of the flange in the loop 26. In accordance with an important feature of the invention, the structure of the actuating means of the wheel detector is implemented in a manner so that the entire wheel detector can be fabricated at low cost.

Figure 2:
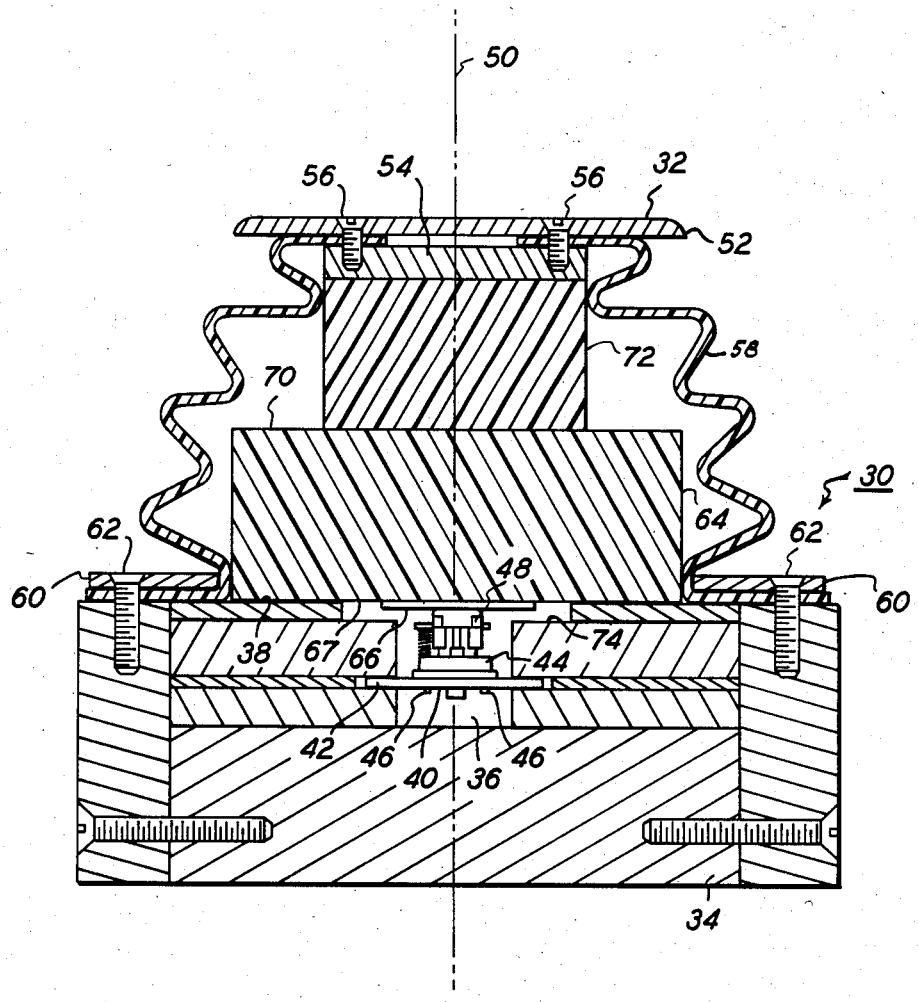
FIG. 2 is a cross-sectional view through a railway wheel detector which is provided in accordance with the invention.
Figure 4:
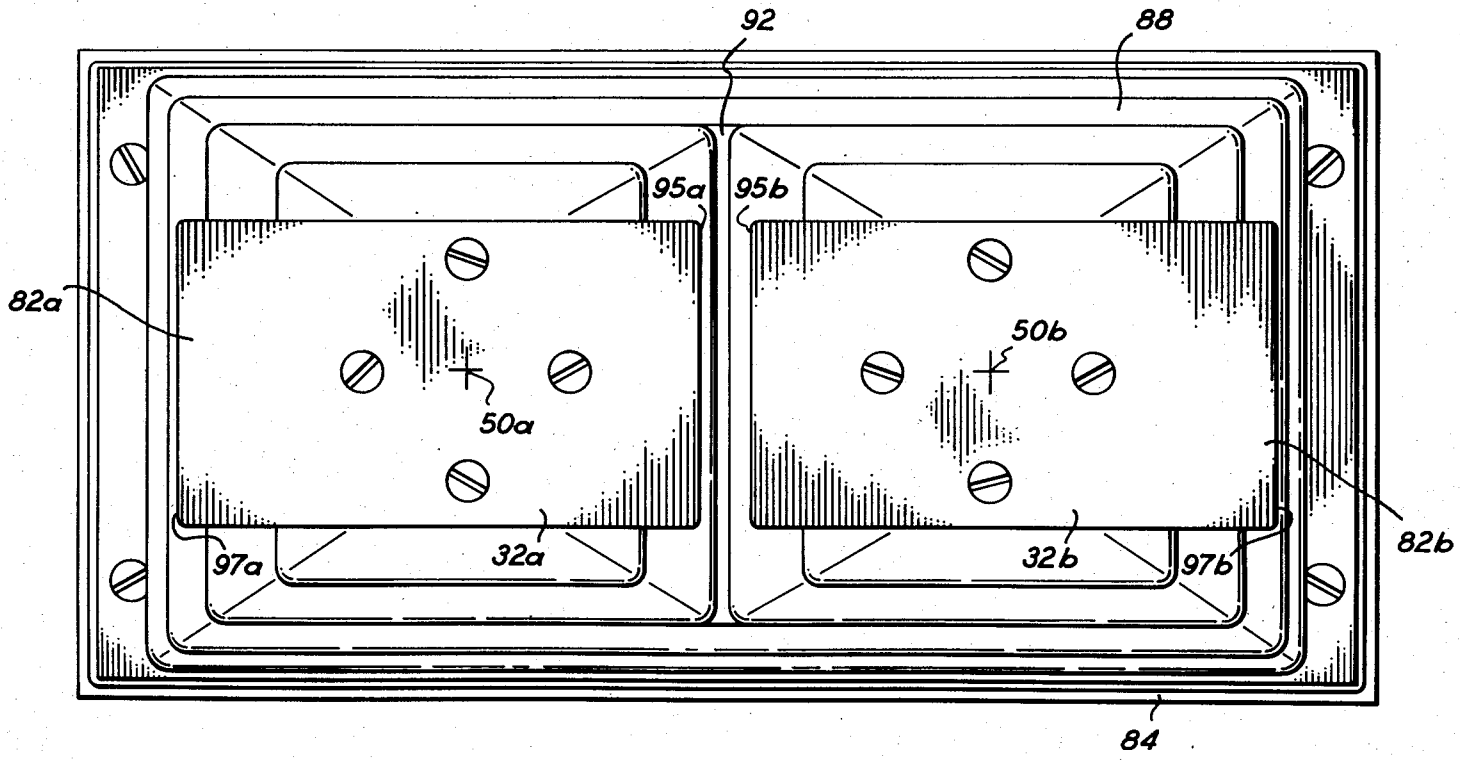
FIG. 4 is a plan view of the railway wheel detector shown in FIG. 3, half of such view being similar to a plan view of the wheel detector which is shown in FIG. 2.

Referring to FIG. 2, there is shown a cross-sectional view through the wheel detector 30. The detector is preferably generally rectangular in shape. The plan view of the detector 30 may be generally similar to one half of the directional wheel detector, the plan view of which is shown in FIG. 4. The detector 30, however may be generally cylindrical or contain cylindrical parts.

A body assembly 34 which is made up of an assembly of blocks, which may be metal, plastic or wood, defines an opening 36 which is a blind opening extending downwardly from an upper surface 38 of the body assembly 34. An electrical switch 40 is mounted in the body assembly 34 within the opening 36. This switch has a circuit board 42 which is captured in a notch provided by the blocks of the body assembly 34. An enclosure containing hermetically sealed contacts 44 is mounted on the board 42. Connections 46 to the contacts extend through the board and may be brought out by leads (not shown) externally of the detector 30. The contacts are made and broken in response to movement in a vertical direction of a plunger 48 which is spring biased upwardly toward the surface 38 of the body 34. This plunger 48 is preferably disposed along the central axis 50 of the detector 30. The switch 40 is preferably a long life hermetically sealed switch of the type used in computer keyboards. The contacts may be balls which are held together in a sleeve which provides a hermetic seal. When the plunger deflects the sleeve, the balls run together so that contact is made. When the plunger is released and moves vertically upward the contact is broken. A suitable switch is available from Mechanical Enterprises, Inc. of Herndon, Va. 22070 USA and is known as their "DN Series Keyswitch".

The flange contacting surface 32 is provided by the top surface of a plate 52 which may be rectangular with longest dimension in the longitudinal direction along the tracks. Another plate 54, which may be of metal or plastic, is attached to the plate 52 by screws 56 which attach the upper end of a boot 58 to the undersurface of the plate 52. The walls of the boot are bellows. The upper end of the wall is sandwiched between the plates 52 and 54 so that the boot provides a seal at the undersurface at the plate 52. The bottom of the wall of the boot 58 is attached at the surface 38 of the body 34 by plates 60 which are held down by screws 62 and also provide a seal at the upper surface 38 of the body 34.

A body 64 of resilient, compressible material is disposed with the surface of the bottom end thereof bearing upon the upper surface 38 of the body 34. A thin, rigid plate 66 is attached to and centered on the base surface 67 of the body 64. This plate 66 serves as a push plate to depress the plunger 48 of the switch 40. The resilient, compressible body 64 bridges the opening 36 in the body assembly 34.

The compressible, resilient material of the body 64 is selected such that it has greater stiffness in the vertical direction (along the central, center line 50) than in the longitudinal direction (along the tracks 18, FIG. 1). Suitably, the body 64 is made of two portions 70 and 72 which may be separate from each other, if desired. The base portion 70 has a larger cross section in a plane perpendicular to the axis 50 than the top portion 72 of the body 64. This dimensional change enhances the differential stiffness (greater in the vertical direction than in the longitudinal direction) of the body 64. The body 64 may be rectilinear and preferably rectangular in the cross section perpendicular to the axis 50. Then, if the boot 58 is also rectilinear in shape (again preferably rectangular), the boot will locate the body 64 and prevent rotation thereof. However the body 64 may be cylindrical and the boot 58 may also be cylindrical in cross section perpendicular to the axis 50. Then it may be desirable to attach, as by cementing, at least the base portion 70 to the inner periphery of the boot 58 at the bottom 67 thereof.

The material of the body 64 is preferably an elastomeric material, which is a closed cell foam. A silicone rubber foam which is characterized by not being permanently settable is suitably used. A suitable specification on such a foam would be that it may be compressible to one half its thickness for 22 hours, and upon release of compression, the set taken does not reduce the thickness by more than 5%. By virtue of the boot 58 having bellows walls, the shape and the material of the body 64, these elements, which provide the principal part of the means for actuating the switch 40, permit initial vertical motion due to the wheel flange contact to actuate the switch 40 and allow the contacting surface 32 to move with the wheel flange as it executes its reverse longitudinal movement, so as to minimize wear at the contacting surface.

In response to the vertical movement of the flange, the body 64 of compressible, resilient material will compress and move downwardly into the opening 36. The body 34 is formed with a shoulder 74 against which the push plate 66 bottoms after $\frac{1}{8}$ of an inch of travel in the vertical direction, to protect the switch contact elements from overtravel of the actuating force. The switch contact closes with about 1/16 of an inch of vertical motion and the switch contact assembly has a total plunger travel of 0.135 inches (these dimensions are given by way of example considering the use of the "DN Series Keyswitch" mentioned above). Other switches may involve somewhat different dimensions. The principle however is to prevent overtravel which may damage the switch.

The prevention of overtravel also enables the proper operation of the wheel detector even when worn wheels actuate the detector. For example, worn wheels (with maximum wear according to specifications used in railway practice) will depress the contacting surface 32 of the detector 30 about $\frac{5}{8}$ of an inch. Since the downward vertical displacement of the switch contact is limited to $\frac{1}{8}$ of an inch (in the above example) by the push plate 66 when it bottoms on the shoulder 74, the additional $\frac{1}{2}$ inch or more of travel is absorbed by the compression of the compressible, resilient body 64. The longitudinal compliance of the actuating means is provided primarily by the top portion 72 of the body 64, which while constrained by the boot 58, permits the contacting surface to move backwards (in the reverse direction to the direction of wheel travel 28 shown in FIG. 1) as the flange travels through the loop 26 of its cycloidal path, thus minimizing the wear on the contacting surface 32.

Figure 3:
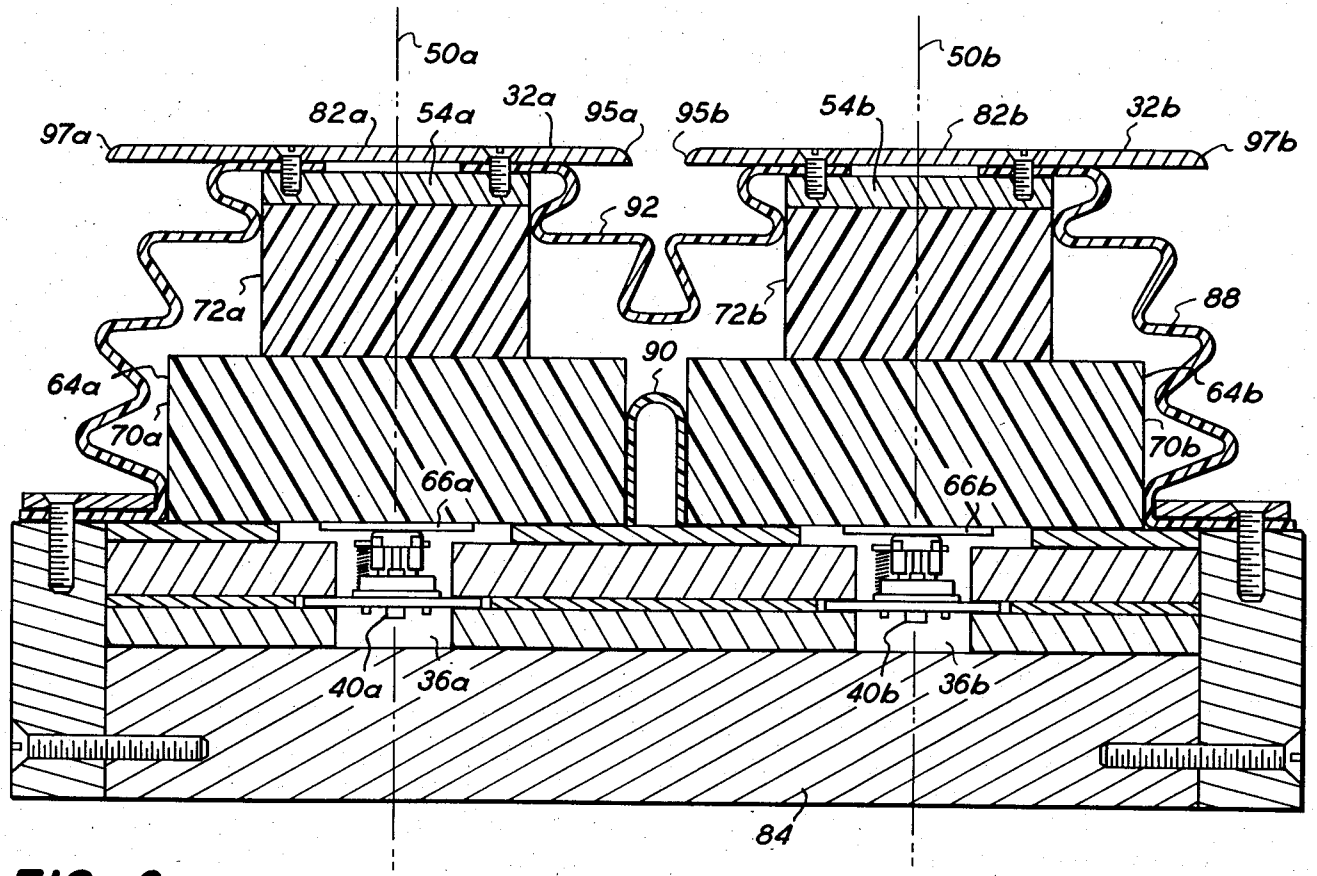
FIG. 3 is a cross-sectional view through a railway wheel detector provided in accordance with another embodiment of the invention which is capable of detecting not only the presence but also the direction of travel of the railway wheel and its wheel axle along the tracks.

Referring to FIGS. 3 and 4 there is shown a bi-directional wheel detector which is capable of detecting the direction of movement of the wheel along the track, and of course the direction of movement of the wheel axle through the use of suitable logic connected to the contact of switches 40*a* and 40*b* like parts to those of the wheel detector shown in FIG. 2 are identified by like reference numerals followed by "a" or "b" since two or such parts are used in the detector shown in FIGS. 3 and 4.

The switches 40*a* and 40*b* are mounted in the openings 36*a* and 36*b* as was the case in the wheel detector of FIG. 2, except that the switches 40*a* and 40*b* are spaced apart from each other in the longitudinal direction (along the railway track). The spacing is sufficient so as to allow the location of two bodies 64*a* and 64*b* of compressible, resilient material to be spaced from each other in a manner to prevent interaction when wheel flange contacts, one of the contacting surfaces 32*a* or 32*b* which might cause both of the switches 40*a* and 40*b* to be actuated. Accordingly, after the wheel flange passes over one of the contacting surfaces, its switch will release and the switch contacts will break, notwithstanding that the contacting sufaces 32*a* and 32*b* are close to each other. It will be observed that a unitary boot 88 of rectangular shape with a valley section 89 between the bodies 64*a* and 64*b* is used. A spacer 90 of resilient material, which may for example be a U-shaped channel, may be disposed between the base portions of the resilient bodies 64*a* and 64*b* to maintain their location. The walls of the boot also locate the resilient bodies 64*a* and 64*b*.

The contacting surfaces 32*a* and 32*b* are the surfaces of plates 82*a* and 82*b*. These plates are shorter, in their lengthwise direction between the central axes 50*a* and 50*b* and the ends 95*a* and 95*b* of the plates which adjoin each other, than between the axes 50*a* and 50*b* and the outer ends 97*a* and 97*b* of the plates. Accordingly, the wheel flange will come into contact with the longer portion of a plate 82*a* or 82*b* first. The actuation of the second switch is then delayed because of the shorter distance between the central axis thereof and the end 95*a* or 95*b* of the plate which is contacted second. Accordingly, although the spacing of the switches 40*a* and 40*b* and actuating means therefore prevents interaction between the switches, the offset of the plates 82*a* and 82*b* enables there to be an overlap in operation of both switches. Accordingly, when the wheel is centered on the bi-directional wheel detector (essentially over the valley 92 in the boot), both switches 40*a* and 40*b* are actuated. As the wheel moves off the detector one switch is released before the other. The logic circuits connected to these switch contacts can then readily decode, from the sequence in which the contacts are made and broken, the direction of travel of the railway wheel, and any reversal in direction of travel.

From the foregoing description it will be apparent that there has been provided improved apparatus for detecting both the presence and the direction of movement of railway wheels. It will be apparent further that the parts from which the detectors described herein are made up are simple blocks and plates so that the detectors can be fabricated at low cost. Of course, variations and modifications of the herein described detectors, within the scope of the invention, will become apparent to those skilled in the art. Accordingly, the foregoing description should be taken as illustrative and not in a limiting sense.

I claim:

1. Apparatus for use on a railway track for detecting flanged wheels of railway vehicles on said track, said apparatus comprising a body of rigid material having an opening therein extending from a surface thereof, an electrical switch having a depressible plunger, said switch being disposed in said body with said plunger in said opening extending upwardly in the direction of said surface, means operated by the flange of a railway vehicle wheel for actuating said switch by depressing and releasing said plunger, said actuating means having a surface contacted by the wheel flange and spaced above the bottom of the cycloidal path of any point on the outer circumference of the flange as it moves along the track so as to move vertically and longitudinally along said track with said flange, said means including a body of compressible, resilient material supporting said contacted surface for said vertical and longitudinal movement, said compressible, resilient body having a surface on one end thereof bearing upon said body surface and bridging said opening, which one end surface moves vertically into contact with said plunger for depressing said plunger when said contacted surface is engaged by said wheel flange.

2. The apparatus according to claim 1 wherein said body of compressible, resilient material has greater stiffness to movement of said contacted surface in the vertical direction than in the longitudinal direction.

3. The apparatus according to claim 1 wherein said material of said body is closed cell foam elastomeric material.

4. The apparatus according to claim 1 wherein said material is closed cell foam silicone rubber.

5. The apparatus according to claim 1 wherein said material is characterized by the property of restoring substantially to its original shape when compressed and the compressive forces thereon are released.

6. The apparatus according to claim 1 wherein said body of compressible, resilient material has a base portion and a top portion with adjoining surfaces, the surface of said base portion opposite to said adjoining surface thereof being said one end surface, the surface of said top portion opposite to said adjoining surface thereof supporting said flange contacted surface, and the cross-sectional area in a plane therethrough perpendicular to the vertical of said top portion being smaller than that of said base portion.

7. The apparatus according to claim 1 wherein said means for actuating said switch further comprises a rigid plate defining said flange contacting surface on the top side thereof and being supported by said body of compressible, resilient material on the underside thereof.

8. The apparatus according to claim 7 wherein said means for actuating said switch further comprises a boot having bellows walls encompassing said body of resilient material and sealingly connected to the underside of said plate and to said body in which said switch is disposed.

9. The apparatus according to claim 7 wherein said body of compressible, resilient material is rectilinear in cross section in a plane therethrough perpendicular to the vertical, and said body has a top portion and a base portion in juxtaposition both rectilinear in cross section in planes therethrough perpendicular to the vertical, and having cross-sectional areas in said planes which in said top portion is smaller than in said base portion, and the walls of said boot being sufficiently close and sufficiently stiff to locate said body of compressible material therein between said plate which defines said contacted surface and the surface of said body in which said switch is disposed and to restrain said body of compressible material against rotation.

10. The apparatus according to claim 1 wherein said means for actuating said switch comprises a rigid plate connected to said surface of said one end of said body of compressible, resilient material and disposed to engage said switch plunger when said body of compressible, resilient material is compressed, said opening in said switch containing body having a shoulder engageable with said rigid plate for limiting the downward vertical movement of said body of resilient, compressible material and thereby also limiting the depression of said plunger by said body of compressible, resilient material.

11. The apparatus according to claim 1 wherein, for use in detecting the direction of travel of said wheels longitudinally along said track, a unitary device having a pair of said switches is provided, said first named body having a pair of openings in which the plungers of said switches are disposed, a pair of bodies of resilient, compressible material each having the surface of the end thereof which bears against the surface of said body in which said switches are disposed each bridging a different one of said openings, said bodies being spaced in said longitudinal direction from each other to support a pair of flange contacting surfaces which are spaced longitudinally from each other, whereby to provide for independent, noninteracting actuation of said switches.

12. The apparatus according to claim 11 wherein vertical axes through the middle of said bodies of compressible, resilient material are each in alignment with the plungers of different ones of said switches, plates of rigid material defining said contacting surfaces, each supported by the top end of a different one of said bodies of compressible resilient material with said surfaces contacted by said wheel flange at the same height.

13. The apparatus according to claim 12 wherein said plates have ends which face each other and ends opposite to said facing ends, the distance between said central axes and said facing ends being shorter than the distance between said axes and said opposite ends of said plates.

14. The apparatus according to claim 13 wherein said plates are rectangular and said bodies are rectilinear in cross-sectional planes perpendicular to said axes.

15. The apparatus according to claim 14 further comprising a boot of rectilinear shape with bellows walls encompassing and locating said bodies of compressible resilient material, said boot being sealingly connected to the sides of said plates opposite to the side which defines said flange contacted surfaces thereof and to said bodies in which said switches are disposed.

16. The apparatus according to claim 11 wherein each of said switches has a contact assembly, operated by the plunger thereof, which is hermetically sealed.

17. The apparatus according to claim 1 wherein said switch has a contact assembly operated by said plunger, which assembly is hermetically sealed.

* * * * *